US012460493B2

(12) United States Patent
Zhang et al.

(10) Patent No.: US 12,460,493 B2
(45) Date of Patent: Nov. 4, 2025

(54) SEAL ENERGIZATION ASSEMBLY, METHOD, AND SYSTEM

(71) Applicant: Baker Hughes Oilfield Operations LLC, Houston, TX (US)

(72) Inventors: Zhihui Zhang, Katy, TX (US); Guijun Deng, The Woodlands, TX (US); Emerson Nunez Moran, Cypress, TX (US)

( * ) Notice: Subject to any disclaimer, the term of this patent is extended or adjusted under 35 U.S.C. 154(b) by 0 days.

(21) Appl. No.: 18/493,320

(22) Filed: Oct. 24, 2023

(65) Prior Publication Data

US 2025/0129682 A1 Apr. 24, 2025

(51) Int. Cl.
*E21B 23/06* (2006.01)

(52) U.S. Cl.
CPC ..... *E21B 23/06* (2013.01)

(58) Field of Classification Search
CPC ..... E21B 23/06; E21B 23/01; E21B 23/0416; E21B 23/065
See application file for complete search history.

(56) References Cited

U.S. PATENT DOCUMENTS 5,695,847 A * 12/1997 Browne ..... H05K 1/0271 428/389
2002/0166672 A1 11/2002 White et al.
2012/0012303 A1 1/2012 Xu
2012/0125640 A1* 5/2012 Sevre ..... E21B 33/1208 166/387
2013/0256991 A1 10/2013 Ramon et al.
2015/0021030 A1 1/2015 Loginov et al.
2015/0204158 A1* 7/2015 Frisby ..... E21B 33/1208 166/387
2020/0362662 A1* 11/2020 Zhang ..... C09K 8/46
2021/0140267 A1* 5/2021 Al-Mousa ..... E21B 33/1295
2021/0277751 A1* 9/2021 Xu ..... E21B 17/08
2024/0200422 A1* 6/2024 Fripp ..... E21B 33/128
2024/0229594 A1* 7/2024 Zhong ..... E21B 33/128

OTHER PUBLICATIONS

Notification of Transmittal of the International Search Report and the Written Opinion of the International Searching Authority, or the Declaration; PCT/US2024/052521; Mail date: Feb. 3, 2025; 8 pages.

* cited by examiner

*Primary Examiner* — Yanick A Akaragwe
(74) *Attorney, Agent, or Firm* — Baker Hughes Company

(57) ABSTRACT

A seal energization assembly, including a seal, a setting arrangement in operative contact with the seal, and a set energy compensation device disposed in operative contact with the seal and add energy to the setting arrangement responsive to a falling environmental temperature. A method for maintaining energy in a seal during temperature down cycling, including automatically compensating for temperature related reduction in the seal energy by expanding a set energy compensating device in contact with the seal. A packer, including a mandrel, a seal on the mandrel, and a setting arrangement in operative contact with the seal, the arrangement including a negative thermal expansion set energy compensation device. A wellbore system, including a borehole in a subsurface formation, a string in the borehole, and a seal energization assembly, disposed within or as a part of the string.

10 Claims, 7 Drawing Sheets

Temp cycle to minimum temp after set

SEAL ENERGIZATION ASSEMBLY, METHOD, AND SYSTEM

BACKGROUND

In the resource recovery and fluid sequestration industries it is common for seals to be used for many different operations. Over the decades, the art has developed myriad configurations to impart energy to a seal and then trap it there to ensure a good seal. Generally, these methods work well for holding trapped energy insofar as they do not actually slip and release energy. But in some situations where temperature down cycling occurs, that affects the seal thermally, and the amount of energy applied to the sealing function may diminish due to thermal contraction of the seal. Fully energized seals are important to a reliable sealing property. The art would welcome technologies that support sealing function.

SUMMARY

An embodiment of a seal energization assembly, including a seal, a setting arrangement in operative contact with the seal, and a set energy compensation device disposed in operative contact with the seal and add energy to the setting arrangement responsive to a falling environmental temperature.

An embodiment of a method for maintaining energy in a seal during temperature down cycling, including automatically compensating for temperature related reduction in the seal energy by expanding a set energy compensating device in contact with the seal.

An embodiment of a packer, including a mandrel, a seal on the mandrel, and a setting arrangement in operative contact with the seal, the arrangement including a negative thermal expansion set energy compensation device.

An embodiment of a wellbore system, including a borehole in a subsurface formation, a string in the borehole, and a seal energization assembly, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
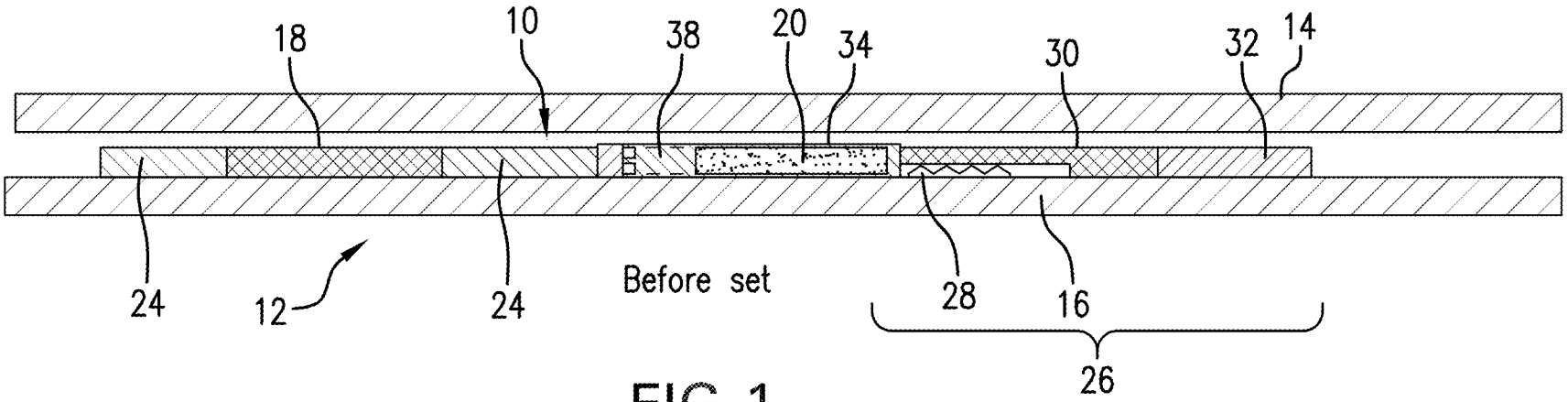
FIG. 1 is a schematic sectional view of a seal tool with a seal energization assembly as disclosed herein in a before set condition.
Figure 2:
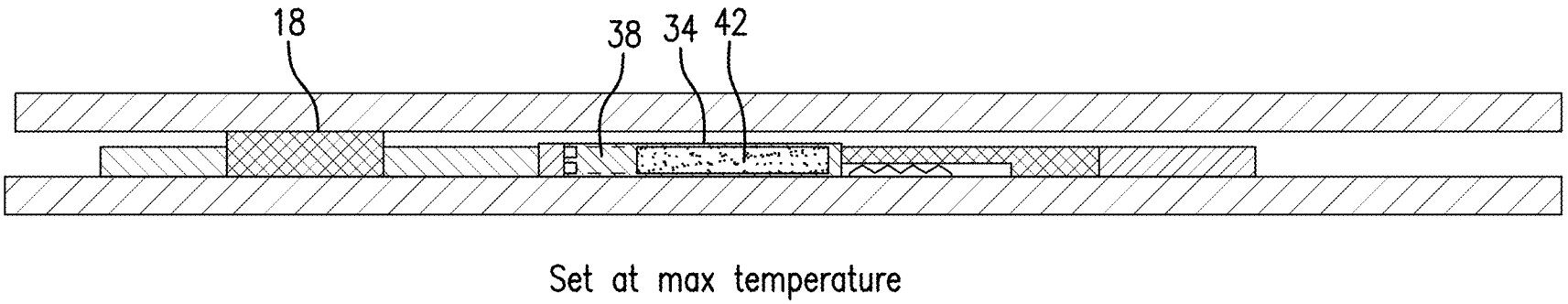
FIG. 2 is the tool of FIG. 1 in a set condition at a non-temperature down cycle.
Figure 3:
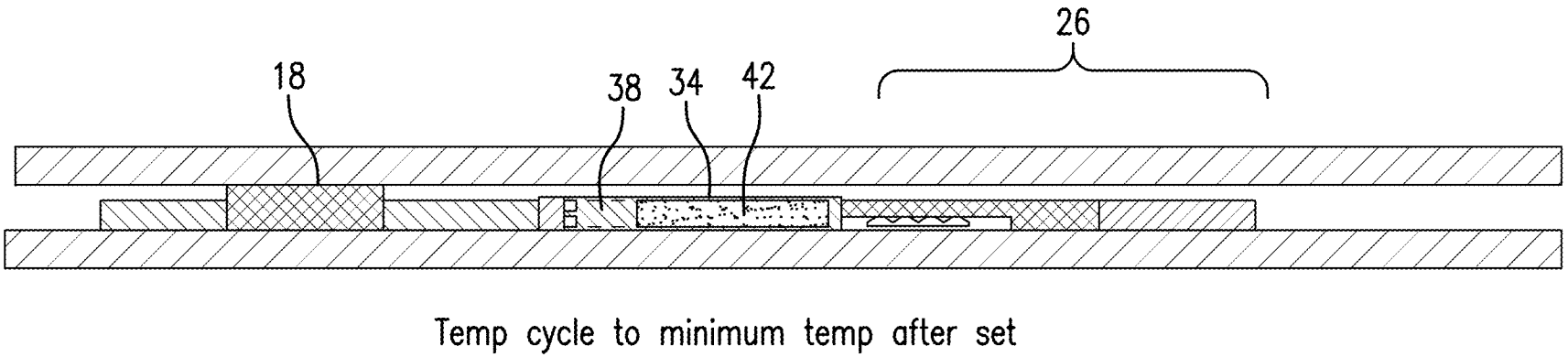
FIG. 3 is the tool of FIG. 1 in a set condition and at a temperature down cycle.

Referring to FIGS. 1-3, a seal energization assembly 10 is illustrated as a part of a seal tool 12 in a borehole 14. The tool 12 includes a mandrel 16 and the assembly 10 is disposed about the mandrel 16 in some embodiments. The assembly 10 may however be disposed on anything that provides structural support thereto.

Assembly 10 as illustrated includes a seal 18 which may form at least a part of a packer element or similar that is caused to grow radially by application of an axially directed compressive load. It is to be understood, however, that an inflatable is also contemplated since temperature down cycling may affect the inflation pressure of an inflatable in a similar way and a set energy compensation device 20 disclosed herein may be applied to such an inflatable in a similar way. Returning to FIGS. 1-3, the compressive seal 18 as illustrated may be disposed adjacent a gauge ring 24 on one or both longitudinal ends of the seal 18. Adjacent one of the gauge rings 24 is the energy compensation device 20 and adjacent the device 20 is a mechanical energy input and hold configuration 26 (alternatively termed anchor herein) that includes in an embodiment, a body lock ring 28, a body lock ring housing 30 and a setting sleeve 32. It will be appreciated that other similar hold configurations or anchors 26 may be substituted without departing from the scope of the present disclosure. Notable is that the device 20 is disposed between the anchor 26 and the seal 18. It is also possible that the device 20 be disposed between the seal 18 and some other kind of hard stop (such as a shoulder, etc.) on the opposite end of the seal 18. In either position, expansion of the device 20 will be directed into the seal because that expansion cannot overcome the anchor 26 or other hard stop.

Figure 4:
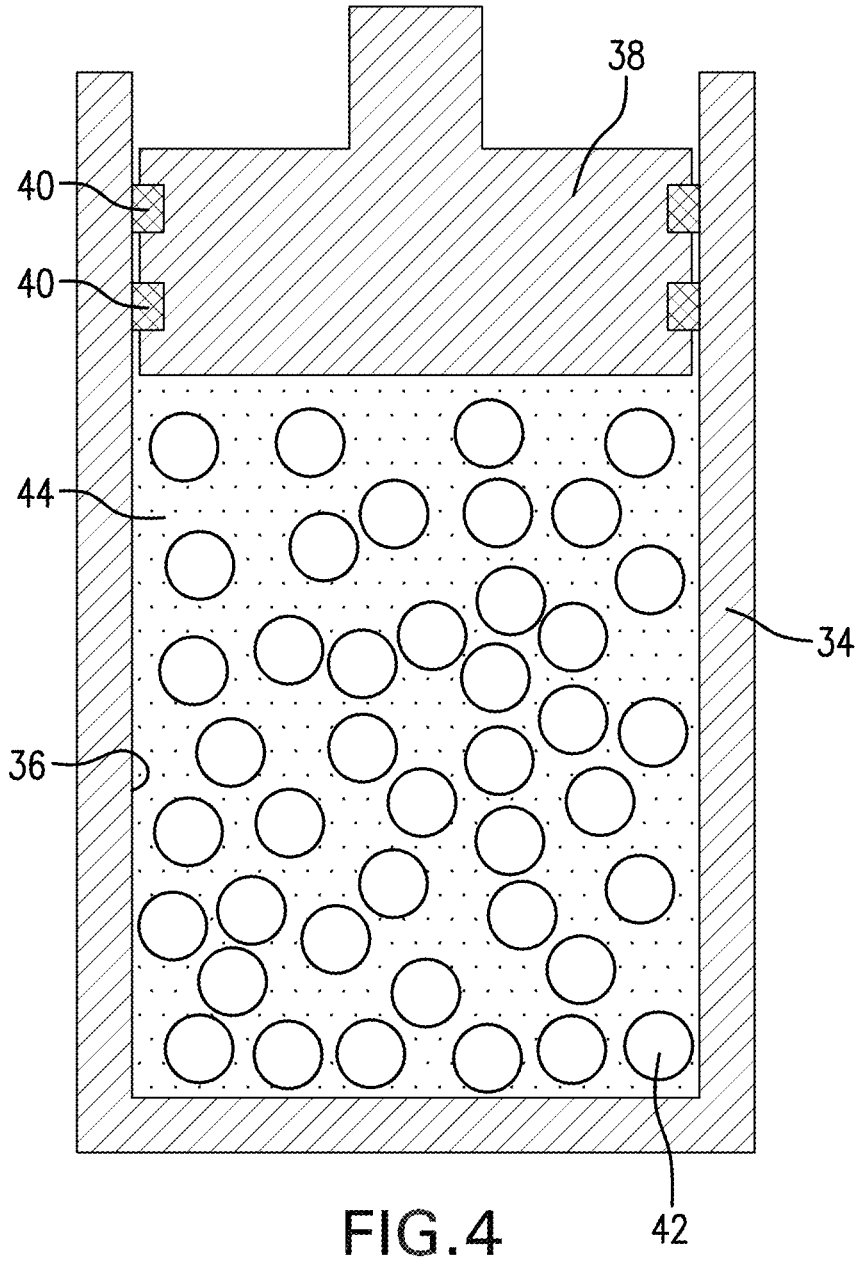
FIG. 4 is a schematic view of an embodiment of a set energy compensation device as disclosed herein.
Figure 4A:
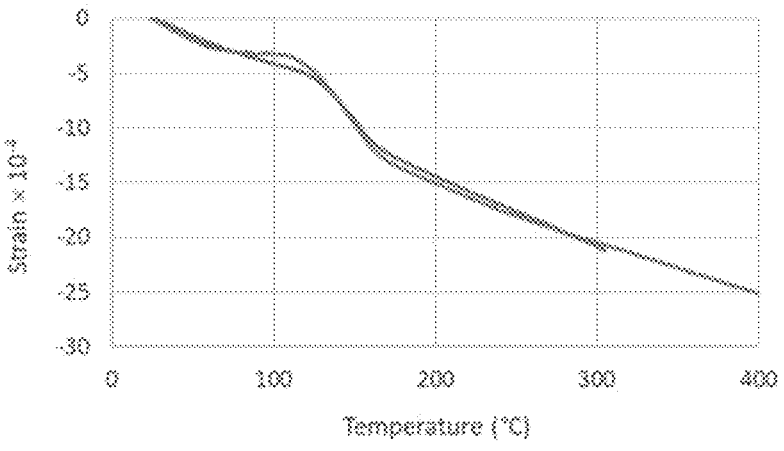
FIG. 4A is a graph of an exemplary strain vs temperature plot.

Referring now to the device 20, visible in each of FIGS. 1-3 and in an enlarged form in FIG. 4, the device 20 includes a housing 34 that defines a chamber 36 therein. A piston 38 is disposed in the housing 34 and is movable relative thereto and dynamically sealed to the housing 34 with seals 40. Contained within the chamber 36 is a material 42 comprising a negative thermal expansion property ("NTE material"). Specifically, the material 42 will physically expand with falling temperature. The material 42 may be configured as a particulate undergoing volumetric expansion with decreasing temperature. In some embodiments, the material 42 may be disposed within a flowable pressure transfer medium 44 that possesses a coefficient of thermal expansion (CTE) that is less than the absolute value of the negative thermal expansion coefficient of the NTE material. In one example, the pressure transfer medium may be selected from silicon nitride, or silicon carbide. Other materials (solid or liquid) are also contemplated providing their CTE is less than the expansion of the NTE in falling temperature. Were this not the case, then the expansion of the NTE could be absorbed by thermal contraction of the transfer medium, rending the compensation device ineffective. The magnitude of piston 38 displacement is determined by the NTE material type, volume fraction of the NTE material in the flowable medium and the temperature drop range. Suitable NTE materials include $_A^1M^1{}_2O_8$, wherein $A^1$ is Zr or Hf and $M^1$ is Mo or W; $A^2P_2O_7$, wherein $A^2$ is Zr, Hf, Ti, U, Th, Pu, Np, Mo, W, Ce, Pb, Sn, Ge or Si; $A^3V_2O_7$, wherein $A^3$ is Zr or Hf; $A^4As_2O_7$, wherein $A^4$ is Zr or Hf; $A^5{}_2M^2{}_3O_{12}$, wherein $A^5$ is $A^1$, Sb, Bi, Co, Ga, Au, Fe, Sc, Ti, Y, Ho, or Yb and $M^2$ is Mo or W; $PbTiO_3$, (Bi,La) $NiO_3$, $LaCu_3Fe_4O_{12}$, or a combination including at least one of the foregoing; $Fe(Co(CN)_6)$, $Zn_3(Fe(CN)_6)_2$, $Ag_3(Co(CN)_6)$, $Cd(CN)_2$, $Co_3(Co(CN)_6)_2$, $Mn_3(Co(CN)_6)_2$, or a combination including at least one of the foregoing; $LiAlSiO_4$, $Mg_2Al_4SisO_{18}$, or a combination including at least one of the foregoing; $Fe_3Pt$;

$Mn_3ZnN$, $Mn_3GaN$, $Mn_3Cu_{0.53}Ge_{0.47}N$, $Mn_3Zn_{0.5}Sn_{0.5}N_{0.85}C_{0.1}B_{0.05}$, $Mn_3Zn_{0.4}Sn_{0.6}N_{0.85}C_{0.15}$, or a combination including at least one of the foregoing. As an example, the graph of FIG. 4A illustrates a strain vs temperature plot for one possible NTE material ($ZrW_2O_8$). The resulting stroke length for the device 20 can be customized by the ratios of NTE material to fluid, and temperature cycle down magnitude anticipated to be experienced.

Figure 5:
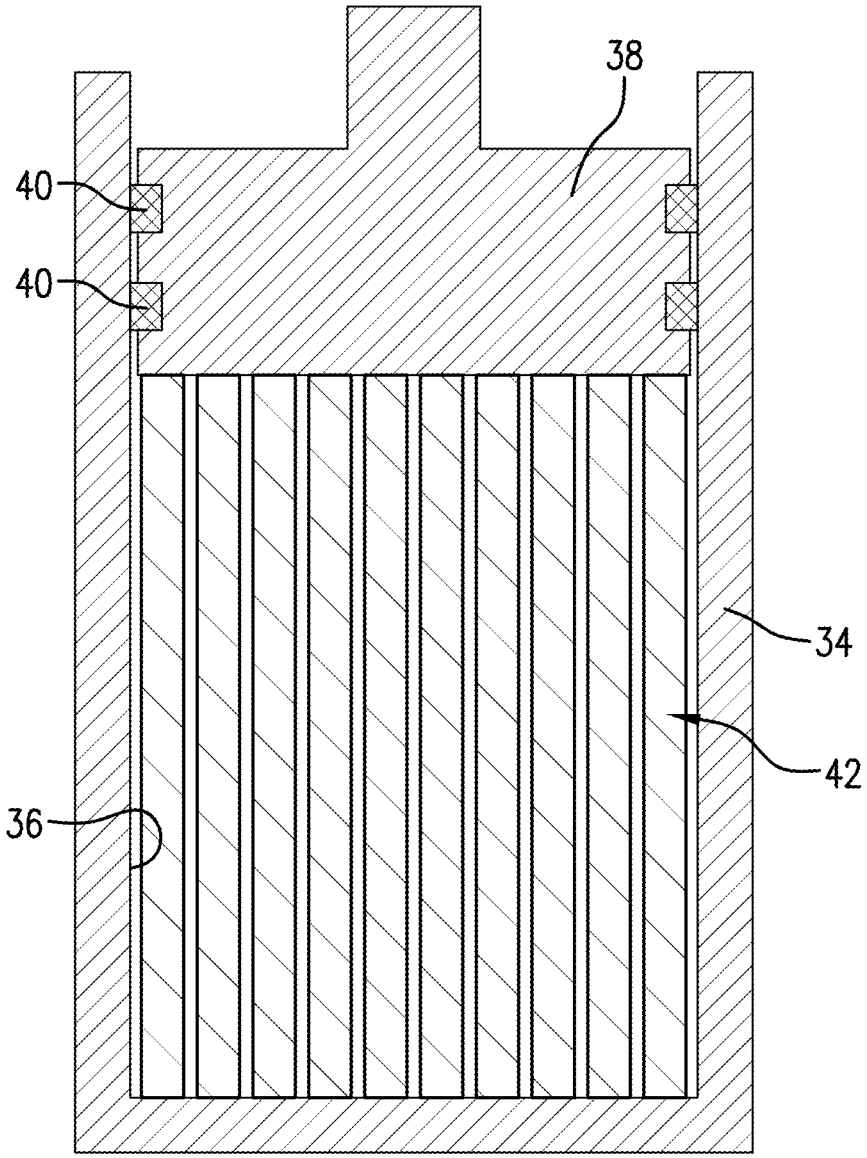
FIG. 5 is an alternate embodiment of a set energy compensation device as disclosed herein.

In another embodiment, referring to FIG. 5, the material 42 may be configured as stacks of sheets NTE material or substituted for by stacks of sheets of shape memory alloy material in which either or the materials 42 or 42 increases in size in at least a direction useful to add energy to the setting arrangement. In the case of shape memory alloys the material undergoes linear expansion with decreasing temperature along a specific crystallographic orientation through thermomechanical training. Shape memory alloys contemplated include but are not limited to Ni—Ti, Ni—Ti—Pd, Co—Ni—Ga, and Ti—Nb alloys. With regard to creating the desired physical action in the shape memory alloys, the thermomechanical training includes, in one example, cold rolling a $Ti_{78}Nb_{22}$ alloy to a 20-80% deformation. This results in the alloy exhibiting expansion upon experiencing decreasing temperature along the rolling direction. Accordingly, the rolled sheet is configured to align its rolling direction to the direction in which the piston moves. Shape memory alloy can be useful in this regard but does experience hysteresis lag. Beneficially, the NTE material expansion and contraction, inversely responding to the temperature, is instantaneous and without hysteresis lag.

As the material 42 physically grows, the piston 38 is moved relative to the housing 34 and is thereby driven into gauge ring 24 and accordingly compresses seal 18. Where a falling temperature will affect the seal 18 and reduce its internal strain due to thermal contraction, that same falling temperature will affect the material 42 by causing its expansion. With that expansion directed back into the seal 18 (through the piston 38 and gauge ring 24) as noted above, the internal strain in seal 18 will fall less or not at all, thereby preserving the integrity of the sealing function.

The device 20 operates automatically, requiring no input to support the seal function when experiencing a temperature down cycle.

Figure 6:
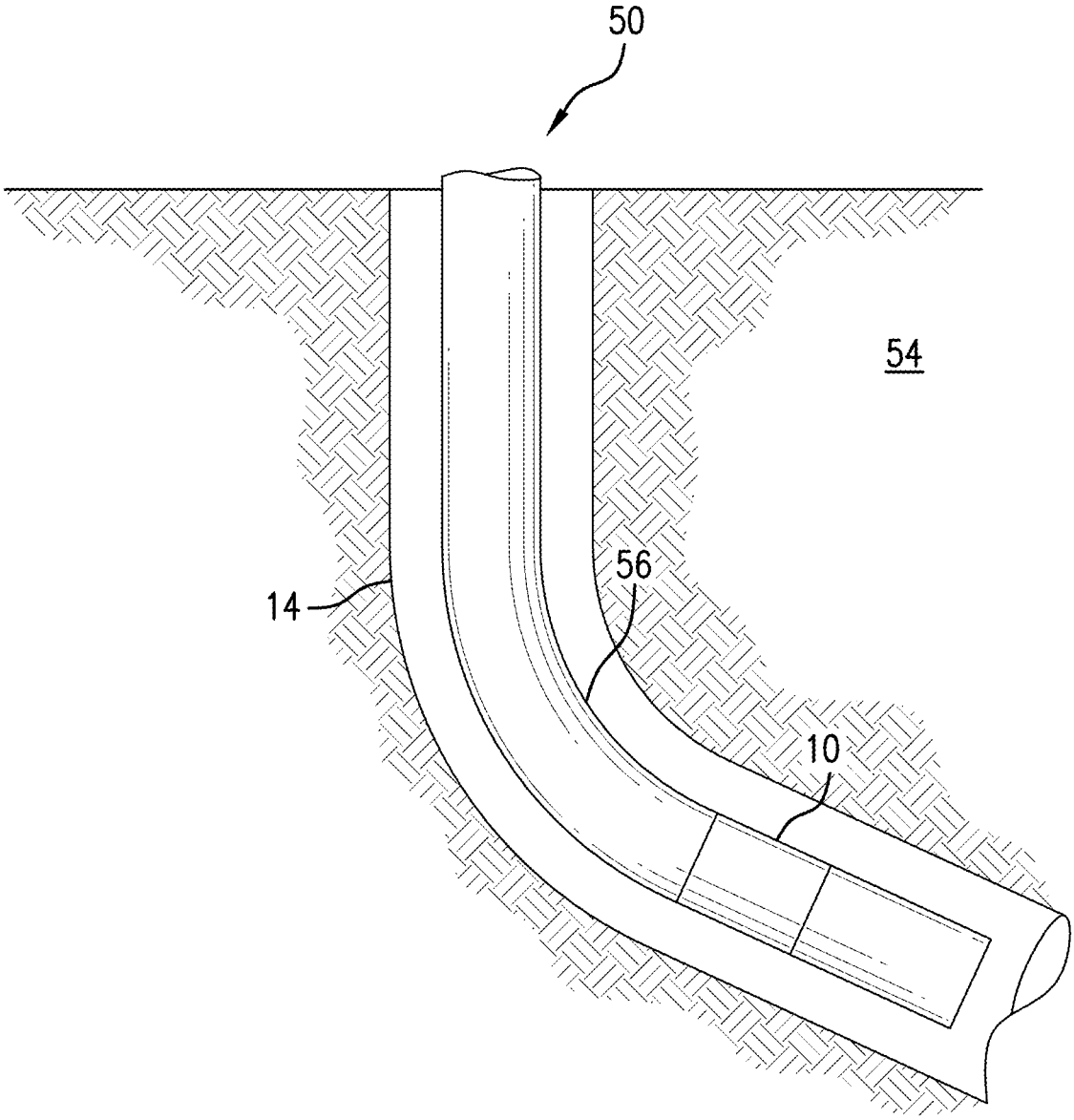
FIG. 6 is a view of a borehole system including the seal energization assembly as disclosed herein.

Referring to FIG. 6, a borehole system 50 is illustrated. The system 50 comprises a borehole 14 in a subsurface formation 54. A string 56 is disposed within the borehole 14. A seal energization assembly 10 as disclosed herein is disposed within or as a part of the string 56.

Set forth below are some embodiments of the foregoing disclosure:

Embodiment 1: A seal energization assembly, including a seal, a setting arrangement in operative contact with the seal, and a set energy compensation device disposed in operative contact with the seal and add energy to the setting arrangement responsive to a falling environmental temperature.

Embodiment 2: The assembly as in any prior embodiment, wherein the device expands in response to a reducing thermal input on the assembly.

Embodiment 3: The assembly as in any prior embodiment, wherein the device includes a negative thermal expansion material.

Embodiment 4: The assembly as in any prior embodiment, wherein the device includes a shape memory alloy.

Embodiment 5: The assembly as in any prior embodiment, wherein the arrangement includes a setting sleeve having a one-way configuration.

Embodiment 6: The assembly as in any prior embodiment wherein the one-way configuration is a body lock ring configuration.

Embodiment 7: The assembly as in any prior embodiment, wherein the device includes a compensating piston in a chamber of a housing.

Embodiment 8: The assembly as in any prior embodiment, wherein the chamber includes a negative thermal expansion material.

Embodiment 9: The assembly as in any prior embodiment, wherein the material is a particulate.

Embodiment 10: The assembly as in any prior embodiment, wherein the particulate is disposed in a noncompressible fluid.

Embodiment 11: A method for maintaining energy in a seal during temperature down cycling, including automatically compensating for temperature related reduction in the seal energy by expanding a set energy compensating device in contact with the seal.

Embodiment 12: The method as in any prior embodiment, wherein the expanding is by increasing dimensions of a negative thermal expansion material associated with the device.

Embodiment 13: The method as in any prior embodiment, further including pressurizing a noncompressible fluid with the material.

Embodiment 14: The method as in any prior embodiment, further including moving a piston in a chamber, the chamber filled with the fluid and the material.

Embodiment 15: The method as in any prior embodiment, wherein the expanding inputs energy into the seal.

Embodiment 16: A packer, including a mandrel, a seal on the mandrel, and a setting arrangement in operative contact with the seal, the arrangement including a negative thermal expansion set energy compensation device.

Embodiment 17: A wellbore system, including a borehole in a subsurface formation, a string in the borehole, and a seal energization assembly as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A seal energization assembly, comprising:

a seal;

a setting arrangement in operative contact with the seal; and a set energy compensation device disposed in operative contact with the seal and add energy to the setting arrangement responsive to a falling environmental temperature, the device including a compensating piston in a chamber of a housing, the chamber including a negative thermal expansion material disposed in a noncompressible fluid.

2. The assembly as claimed in claim 1, wherein the device expands in response to a reducing thermal input on the assembly.

3. The assembly as claimed in claim 1, wherein the device material includes a shape memory alloy.

4. The assembly as claimed in claim 1, wherein the arrangement includes a setting sleeve having a one-way configuration.

5. The assembly as claimed in claim 4 wherein the one-way configuration is a body lock ring configuration.

6. The assembly as claimed in claim 1, wherein the material comprises a plurality of particles.

7. A packer, comprising:

a mandrel;

and a seal energization assembly as claimed in claim 1 arranged in operative contact with the mandrel.

8. A wellbore system, comprising:

a borehole in a subsurface formation;

a string in the borehole; and a seal energization assembly as claimed in claim 1, disposed within or as a part of the string.

9. A method for maintaining energy in a seal during temperature down cycling, comprising:

automatically compensating for temperature related reduction in the seal energy by expanding a set energy compensating device in contact with the seal by increasing dimensions of a negative thermal expansion material associated with the device and pressurizing a noncompressible fluid with the material thereby moving a piston in a chamber, the chamber filled with the fluid and the material.

10. The method as claimed in claim 9, wherein the expanding inputs energy into the seal.

* * * * *